United States Patent [19]

Sato et al.

[11] 4,353,847

[45] Oct. 12, 1982

[54] FUEL SUPPLY SYSTEM FOR SMALL ENGINE

[75] Inventors: Masato Sato, Akashi; Masanobu Yamashita, Miki, both of Japan

[73] Assignee: Kawasaki Jukogyo Kabushiki Kaisha, Kobe, Japan

[21] Appl. No.: 335,014

[22] Filed: Dec. 28, 1981

[30] Foreign Application Priority Data

Dec. 26, 1980 [JP] Japan ..... 55-188404

[51] Int. Cl.[3] ..... F02M 17/06

[52] U.S. Cl. ..... 261/36 A; 261/DIG. 50; 261/66; 261/72 R

[58] Field of Search ..... 261/DIG. 50, 72 R, 66, 261/36 A

[56] References Cited

U.S. PATENT DOCUMENTS

| | | | |
|---|---|---|---|
| 2,120,975 | 6/1938 | Heftler | 261/72 R |
| 2,635,625 | 4/1953 | Moseley et al. | 261/DIG. 50 |
| 2,750,172 | 6/1956 | Burrows et al. | 261/72 R |
| 3,208,739 | 9/1965 | Phillips | 261/36 A |
| 3,262,433 | 7/1966 | Jordan | 261/DIG. 50 |
| 3,275,307 | 9/1966 | Robechaud | 261/DIG. 50 |
| 3,695,590 | 10/1972 | Nishihara | 261/DIG. 50 |
| 3,767,173 | 10/1973 | Ishii | 261/36 A |
| 3,825,238 | 7/1974 | Nishihara et al. | 261/DIG. 50 |
| 4,289,714 | 9/1981 | Duncan | 261/DIG. 50 |

FOREIGN PATENT DOCUMENTS

| | | | |
|---|---|---|---|
| 452949 | 11/1948 | Canada | 261/72 R |

*Primary Examiner*—Tim R. Miles

*Attorney, Agent, or Firm*—Jordan and Hamburg

[57] ABSTRACT

A fuel supply system for a small engine including a constant level fuel chamber for receiving fuel from a fuel tank through a fuel drawing pipe to eject the fuel into a carburetor through a main nozzle after temporarily storing the fuel therein. A cover is provided to enclose the fuel drawing pipe and the constant level fuel chamber to separate the fuel drawing pipe and the constant level fuel chamber from a fuel storing section in the fuel tank, to enable fuel of a constant flow rate to be fed to the carburetor through the main nozzle irrespective of variations in the liquid level in the fuel storing section.

3 Claims, 6 Drawing Figures

FUEL SUPPLY SYSTEM FOR SMALL ENGINE

BACKGROUND OF THE INVENTION

This invention relates to fuel supply systems for small engines in general, and more particularly it is concerned with a fuel supply system for a small engine of the type suitable for use as a power source for a tiller.

In the fuel supply system of this type of small engine, it is well known that a fuel tank is mounted on the underside of a carburetor and connected to a constant level fuel chamber via a fuel drawing pipe so as to draw the fuel in the fuel tank into the constant level fuel chamber to temporarily store same therein, whereby the fuel temporarily stored in the constant level fuel chamber can be ejected into the carburetor through a main nozzle.

No trouble is encountered when this type of engine is used if the fuel tank is in a horizontal position. However, in case this type of engine tilts to a large degree, the following troubles would occur. If the fuel tank is filled with fuel when the engine tilts, the liquid level would be disposed higher than the level of the main nozzle and the fuel would inadvertently flow from the main nozzle to overenrich the fuel-air mixture, with the result that the engine would be rendered inoperative. On the other hand, if the fuel in the tank is very small in quantity when the engine tilts, the fuel could not be drawn by suction and the engine would be rendered inoperative.

This type of small engine is disadvantageous as compared with an engine of the float type in that there are limits to the degree of tilting thereof when in service. When this type of small engine is used as a power source of a tiller, for example, the tiller itself will be limited to the degree of tilting of the engine. The tiller often tilts to a large degree in view of the nature of the work it is required to do, so that the performance of the tiller would be greatly reduced if it is restricted by the degree of tilting of its engine.

SUMMARY OF THE INVENTION

This invention has been developed for the purpose of obviating the aforesaid disadvantage of the prior art. Accordingly the invention has as its object the provision of a fuel supply system for a small engine which is free from the risk of being rendered inoperative at once even if the liquid level in the fuel tank shows variations when the engine temporarily tilts.

The aforesaid object is accomplished in the present invention by providing, in a fuel supply system for a small engine of the aforesaid type, a cover for enclosing a constant level fuel chamber and a fuel drawing pipe so as to separate the constant level fuel chamber and the fuel drawing pipe from a fuel storing section in a fuel tank, and the cover is formed at its bottom with a communication port for communicating a fuel feeding section in the cover with the fuel storing section in the fuel tank.

By virtue of this construction, when the fuel tank tilts through an angle which is larger than a predetermined angle, the liquid level in the fuel storing section of the fuel tank becomes higher than the level of the main nozzle if the fuel tank is fully loaded, but the liquid level of the fuel feeding section within the cover is lower than the level of the main nozzle. Thus there is no inadvertent flow of fuel through the main nozzle to the carburetor, thereby avoiding the fuel-air mixture being overenriched. When the fuel tank is small in quantity when the engine tilts, the liquid level in the fuel storing section is lower than the lower end of the drawing pipe, but fuel remains in the lower portion of the fuel feeding section, to thereby enable fuel to be fed continuously without interruption to the carburetor through the drawing pipe.

According to the invention, the communication port formed at the bottom of the cover in the aforesaid construction is provided with valve means for opening and closing the communication port, the valve means being operative to close the communication port when the engine and hence the fuel tank tilts through an angle which is larger than the predetermined angle and otherwise keeps the communication port open.

By virtue of the provision of the valve means, feeding of the fuel to the carburetor through the main nozzle is facilitated.

This type of engine has suffered the disadvantage, as described hereinabove, of being restricted by the angle of tilting of the fuel tank as compared with an engine equipped with a float type carburetor. However, the invention eliminates the influences which would otherwise be exerted by variations in the liquid level of the fuel tank on the performance of the engine which occur when the engine tilts. Thus the invention greatly improves the engine tilting characteristic, with the result that no matter how the engine tilts through an angle greater than the predetermined angle, it is possible to continuously and smoothly supply fuel to the carburetor for a predetermined time irrespective of the quantity of fuel in the fuel tank. Thus the trouble of the engine being inadvertently rendered inoperative can be eliminated, and the engine has a tilting limit such that its performance is better than that of an engine provided with a float type carburetor.

DESCRIPTION OF THE PREFERRED EMBODIMENTS

Figure 6:
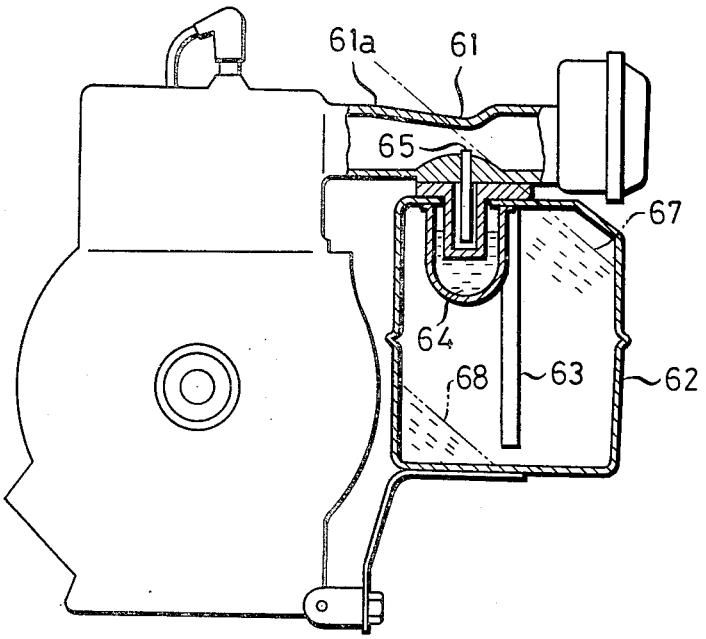
FIG. 6 is a front view of a small engine of the prior art, with certain parts being cut out.

Before describing the present invention in detail, a fuel supply system of the prior art will be outlined. As shown in FIG. 6, a fuel tank 62 is attached to the underside of a carburettor 61 of a small engine of the prior art. Fuel in the fuel tank 62 is drawn by suction by the pumping action of a diaphragm, not shown, through a drawing pipe 63 into a constant level fuel chamber 64 wherein it is temporarily stored before being injected into the carburettor 61 through a main nozzle 65. In spite of the fact that a tiller tilts over a wide range of angles while in service in the nature of the job it is required to do, the aforesaid fuel supply system for a small engine has its tilting capabilities greatly restricted. More specifically, when the tiller tilts at a large angle, a liquid level 67 would become higher than the main nozzle 65 and the fuel would overflow the main nozzle 65 if the fuel tank 62 is fully loaded, so that the fuel-air mixture would be overenriched and the engine would stop operating. If the fuel in the fuel tank 62 is small in quantity, the liquid level 68 would not reach the lower end of the drawing pipe 63, thereby making it impossible to draw the fuel from the fuel tank 62, thereby also causing the engine to stop operating. As stated hereinabove, this invention has been developed for the purpose of obviating the aforesaid disadvantages of the prior art.

Figure 1:
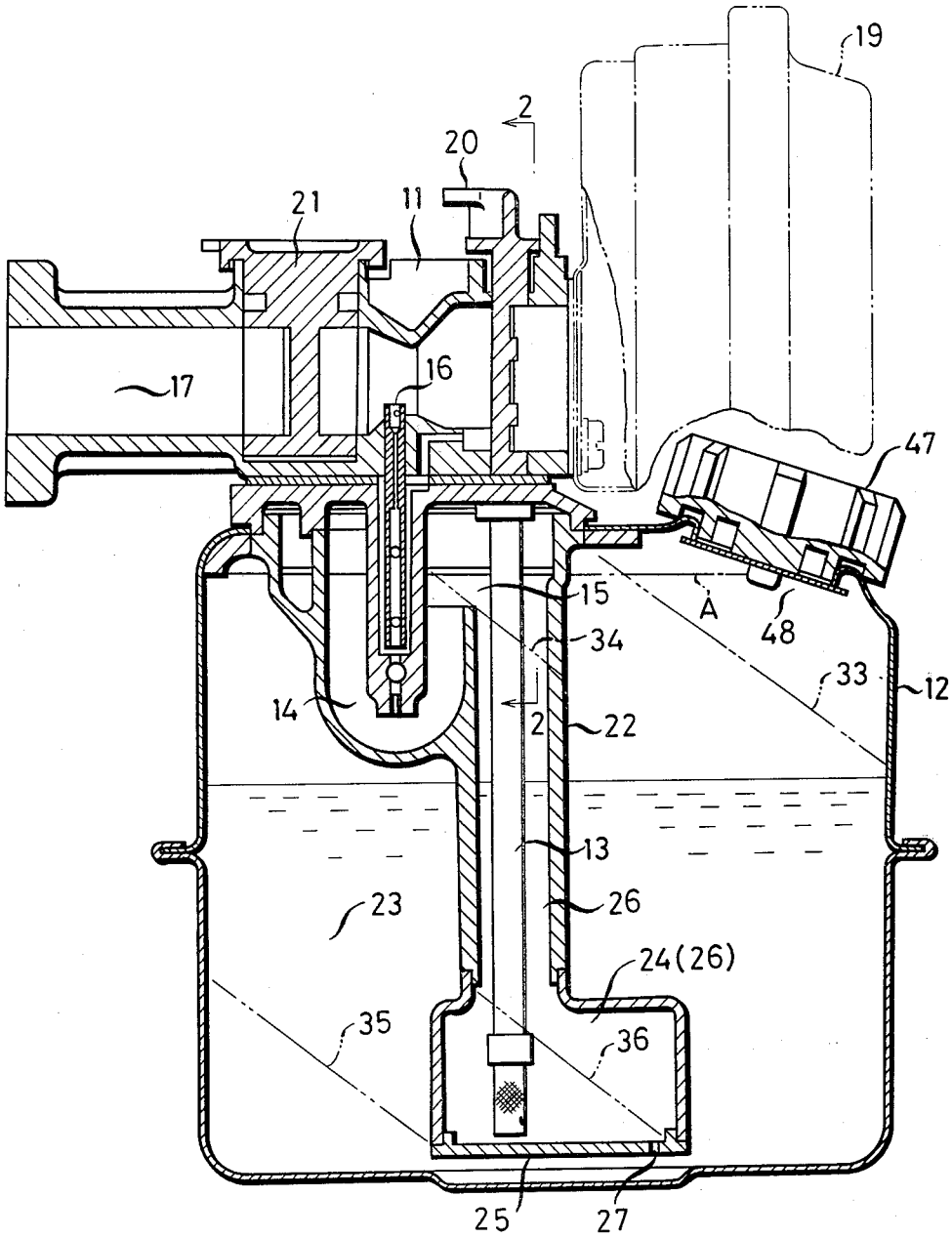
FIG. 1 is a vertical sectional view of the fuel supply system of an engine comprising one embodiment of the invention.

The accompanying drawings show preferred embodiments of the invention. Referring to FIG. 1, a fuel tank 12 is attached to the underside of a carburetor 11, and a fuel drawing pipe 13 and a constant level fuel chamber 14 for temporarily storing the fuel drawn through the pipe 13 from the tank 12 are attached to the carburetor 11 and disposed in the tank 12. The constant level fuel chamber 14 is formed at its peripheral wall with an opening 15 for releasing excess fuel from the constant level fuel chamber 14 to keep the liquid level therein constant. The constant level fuel chamber 14 has a main nozzle 16 extending through the central portion for ejecting therethrough the fuel in the constant level fuel chamber 14 into a suction conduit 17 after the fuel is drawn by the pumping action of a diaphragm, not shown, through the drawing pipe 13 from the tank 12 and temporarily stored in the constant level fuel chamber 14. The numerals 19, 20, 21 and 47 designate an air cleaner, a choke valve, a throttle valve and a cap for covering fuel feeding port 48, respectively.

The numeral 22 designates a cover made of plastics for enclosing the drawing pipe 13 and the constant level fuel chamber 14 to separate the drawing pipe 13 and the constant level fuel chamber 14 from a fuel storing section 23 in the fuel tank 12. The cover 22 is formed at its upper portion with a fuel feeding section 26 and at its lower portion with a bulge communicating with the fuel feeding section 26 and serving as a fuel sump 24, and has a bottom 25 formed with a communication port 27 for maintaining the fuel storing section 23 with the fuel sump 24. The excess fuel in the constant level fuel chamber 14 flows through the opening 15 into the fuel feeding section 26, so as to keep constant the liquid level in the constant level fuel chamber 14.

Figure 2:
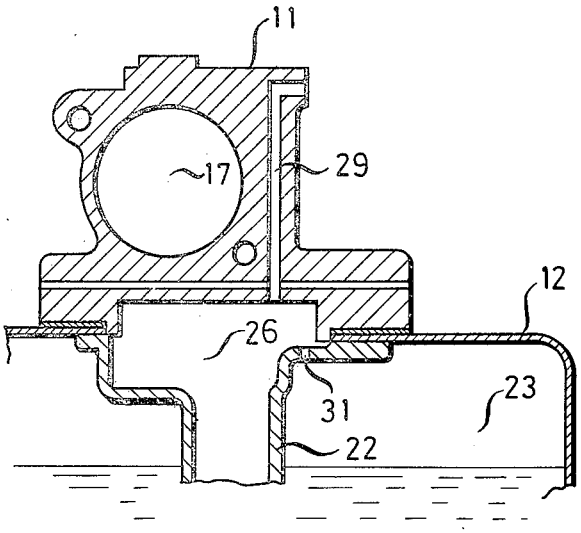
FIG. 2 is a sectional view taken along the line 2—2 in FIG. 1.

The carburetor 11 is formed, as shown in FIG. 2, with a communication passage 29 for maintaining communication between the fuel feeding section 26 and the atmosphere which serves as an air bleed for the fuel feeding section 26 in the cover 22. Moreover, the cover 22 is formed at its upper portion with a breather port 31 (see FIG. 2) for communicating the fuel feeding section 26 with the fuel storing section 23 of the fuel tank 12. The fuel tank 12 has a fuel inlet port, occupying a predetermined space, which is located in a position in which the quantity of the incoming fuel is restricted by the liquid level A which is set by the overflowing port 15, even when the tank 12 is full.

In the aforesaid construction, when the fuel tank 12 shown in FIG. 1 is disposed horizontal, the fuel is introduced from the fuel storing section 23 into the fuel section 26 in the cover 22 through the communication port 27 at the bottom 25 of the cover 22 and drawn by suction through the drawing pipe 13 into carburetor 11.

When the fuel tank 12 tilts through over a predetermined angle or over 30 degrees, for example, a liquid level 33 in the fuel storing section 23 becomes higher than the level of the main nozzle 16 as is the case with the prior art, if the tank 12 is full. However, a liquid level coming into contact with the main nozzle 16 or a liquid level 34 in the fuel feeding section 26 in the cover 22 becomes lower than the level of the main nozzle 16, so that overflow of the fuel through the main nozzle 16 to the suction conduit 17 can be prevented. While the fuel tank 12 is in this condition, the fuel is introduced through the communication port 27 into the fuel feeding section 26 and its liquid level 34 gradually rises. However, it takes a long time for the fuel drawn into the engine to become overenriched and render the engine inoperative, so that no trouble occurs in actual practice.

If the fuel in the fuel tank 12 is small in quantity when the tank tilts through over a predetermined angle, then a liquid level 35 in the fuel storing section 23 becomes lower than the level of the lower end of the drawing pipe 13. However, since fuel remains in the fuel sump 24 in the lower portion of the cover 22, fuel is continuously drawn by suction through the drawing pipe 13. In this condition, the fuel in the fuel feeding section 26 gradually returns through the communication port 27 into the fuel storing section 23, but the returned oil is relatively small in quantity and causes no trouble at all. By shaping the fuel sump 24 in the lower portion of the cover 22 in such a manner that it bulges in a direction opposite to the direction of inclination with the drawing pipe 13 serving as a reference, it is possible to raise a liquid level 36 and to advantageously prolong the time in which the fuel is continuously drawn by suction.

Figure 3:
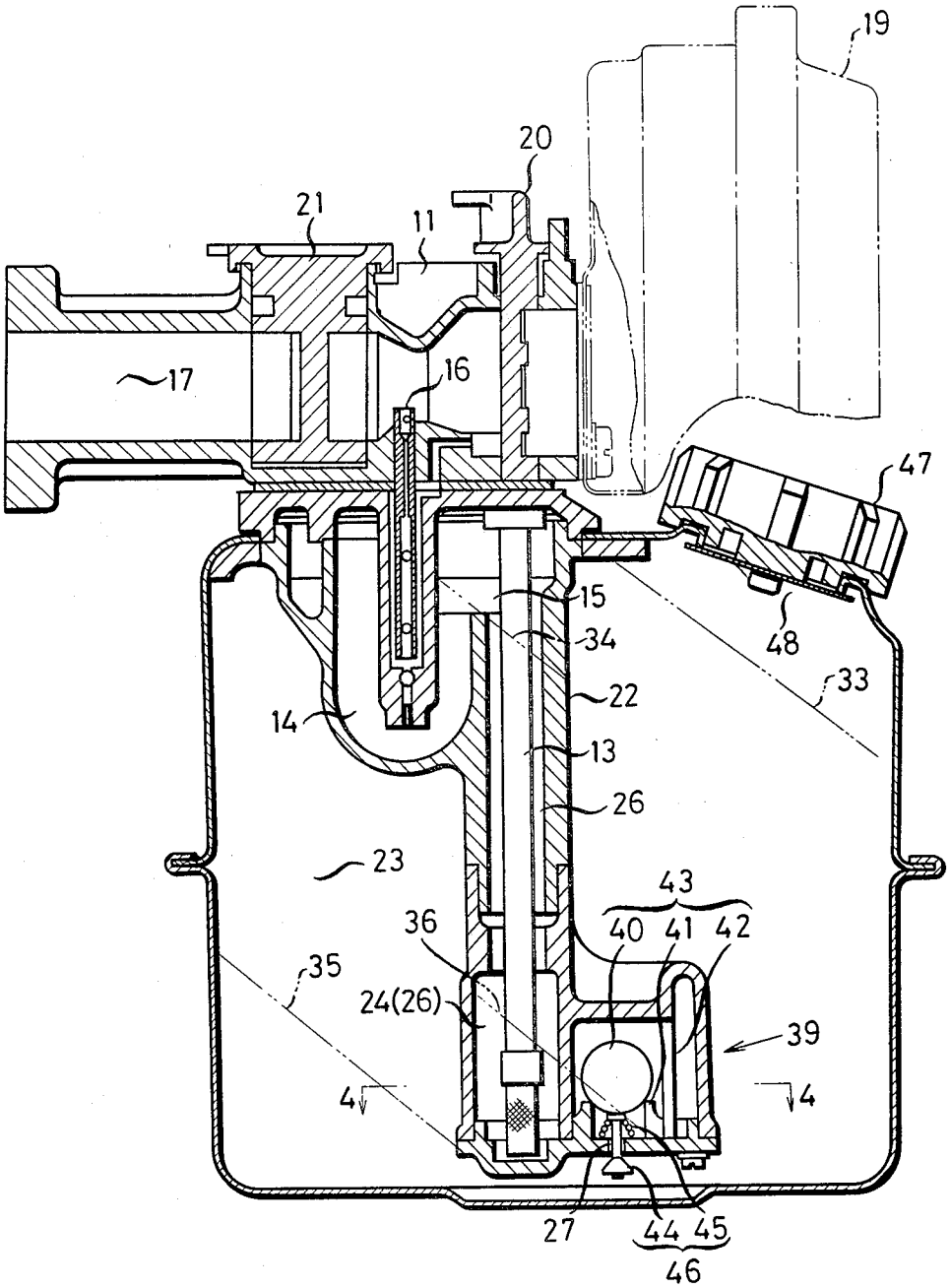
FIG. 3 is a vertical sectional view of the fuel supply system of an engine comprising another embodiment of the invention.

FIG. 3 shows a second embodiment of the invention, in which valve means 39 for opening and closing the communication port 27 is provided to the lower portion of the cover 22. The valve means 39 comprises a ball 40, a seat 41 an tilting angle detecting means comprising a regulating vertical wall 42, and a valve 46 comprising a valve body 44 and a coil spring 45. The detecting means 43 is operative to detect the tilting of the fuel tank 12 through over a predetermined angle or 30 degrees, for example, and drives the valve 46 to close the communication port 27.

Figure 4:
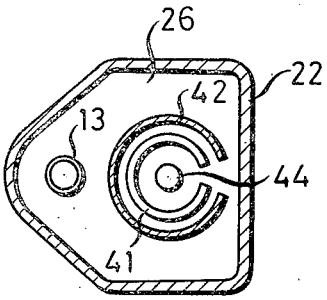
FIG. 4 is a sectional view taken along the line 4—4 in FIG. 3.
Figure 5:
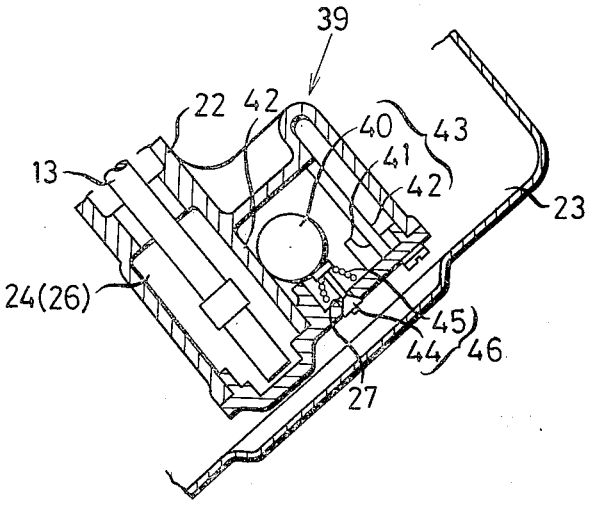
FIG. 5 is a view in explanation of operation of the embodiment shown in FIG. 3.

More specifically, the ball 40 of the detecting means 43 is a metal ball and the seat 41 is a cylindrical wall partly cut out as shown in FIG. 4. When the tilting of the fuel tank 12 in FIG. 3 is below the predetermined level, the ball 40 is supported by the seat 41 in an open valve position; when the tilting of the fuel tank 12 exceeds the predetermined angle, the ball 40 is released from the seat 41 as shown in FIG. 5 to perform a detecting operation. Thus the ball 40 is supported by the regulating vertical wall 42 in such a manner that as soon as tilting of the fuel tank 12 becomes below the predetermined angle the ball 40 returns to the open valve position. Stated differently, the position of the ball 40 is regulated by the vertical wall 42 lest the ball 40 should be dislodged from the seat 41 completely.

The valve body 44 of the valve 46 is pressed downwardly by the ball 40 supported in the open valve position as shown in FIG. 3, to thereby open the communication port 27 to bring the fuel feeding section 26 in the cover 22 into communication with the fuel storing section in the fuel tank 12. The spring 45 of the valve 46 urges by its biasing force the valve body 44 to move upwardly. Thus when the ball 40 is in the closed valve position as shown in FIG. 5, the valve body 44 is restored to its upper position to close the communication port 27, to thereby bring the fuel feeding section 26 out of communication with the fuel storing section 23.

In the aforesaid construction, when the fuel tank 12 tilts through over the predetermined angle, the fuel is prevented from overflowing through the main nozzle 16 into the suction conduit 17 even if the tank 12 is full, and the fuel is continuously drawn by suction through the drawing pipe 13 in the same manner as the fuel tank 12 without the valve means 39, even if the fuel in the tank 12 is small in quantity.

In the embodiment shown in FIG. 3, the communication port 27 is closed by the action of the valve means 39 when the fuel tank 12 tilts through over a predetermined angle. This eliminates the disadvantages that the liquid level 34 in the fuel feeding section 26 in the cover 22 would rise when the tank 12 is full and the fuel in the fuel feeding section 26 would leak when the fuel in the tank 12 is small in quantity. Thus feeding of the fuel to the carburetor 11 can take place smoothly over a prolonged period of time.

What is claimed is:

1. A fuel supply system for a small engine comprising a fuel tank mounted on the underside of a carburetor, and a constant level fuel chamber receiving fuel from the fuel tank through a fuel drawing pipe to store same temporarily therein and eject same into the carburetor, such fuel supply system further comprising:

a cover enclosing said fuel drawing pipe and said constant level fuel chamber to separate the fuel drawing pipe and the constant level fuel chamber from a fuel storing section in the fuel tank; and a communication port formed at the bottom of said cover for communicating a fuel feeding section in the cover with the fuel storing section.

2. A fuel supply system for a small engine comprising a fuel tank mounted on the underside of a carburetor, and a constant level fuel chamber receiving fuel from the fuel tank through a fuel drawing pipe to store same temporarily therein and eject same into the carburetor, such fuel supply system further comprising:

a cover enclosing said fuel drawing pipe and said constant level fuel chamber to separate the fuel drawing pipe and the constant level fuel chamber from a fuel storing section in the fuel tank;

a communication port formed at the bottom of said cover for communicating a fuel feeding section in the cover with the fuel storing section; and valve means for opening and closing said communication port, said valve means comprising a detecting means for detecting the tilting of the fuel tank through over a predetermined angle, and a valve closing the communication port when the detecting means detects the tilting of the fuel tank through over a predetermined angle and actuates the valve.

3. A fuel supply system for a small engine as claimed in claim 2, wherein said detecting means of said valve means comprises a ball, a seat supporting said ball in an open valve position when the tilting angle of the fuel tank is below the predetermined angle, and a regulating vertical wall operative to regulate the position of the ball such that it supports the ball in a closed valve position as the ball is dislodged from the seat when the tilting angle of the fuel tank is over the predetermined angle and it returns the ball to the open valve position when the tilting angle of the fuel tank becomes less than the predetermined angle; and said valve of said valve means comprises a valve body pressed downwardly by the ball supported in the open valve position to open the communication port, and a spring urging by its biasing force the valve body to return to its upper position.

* * * * *